US010458761B2

(12) United States Patent
Collier

(10) Patent No.: US 10,458,761 B2
(45) Date of Patent: Oct. 29, 2019

(54) FLUTED LINEAR SHAPED CHARGE WITH SIMULTANEOUS INITIATION

(71) Applicant: Nicholas Collier, Smithville, TX (US)

(72) Inventor: Nicholas Collier, Smithville, TX (US)

( * ) Notice: Subject to any disclaimer, the term of this patent is extended or adjusted under 35 U.S.C. 154(b) by 55 days.

(21) Appl. No.: 15/910,885

(22) Filed: Mar. 2, 2018

(65) Prior Publication Data

US 2018/0252507 A1 Sep. 6, 2018

Related U.S. Application Data

(60) Provisional application No. 62/466,296, filed on Mar. 2, 2017.

(51) Int. Cl.

| | |
|---|---|
| ***E21B 43/118*** | (2006.01) |
| ***F42B 1/028*** | (2006.01) |
| ***E21B 29/02*** | (2006.01) |
| ***E21B 43/117*** | (2006.01) |
| ***F42B 3/26*** | (2006.01) |

(52) U.S. Cl.

CPC ..... *F42B 1/028* (2013.01); *E21B 29/02* (2013.01); *E21B 43/117* (2013.01); *F42B 3/26* (2013.01)

(58) Field of Classification Search

USPC ..... 149/2, 109.4

See application file for complete search history.

(56) References Cited

U.S. PATENT DOCUMENTS

| | | | | |
|---|---|---|---|---|
| 3,443,518 A * | 5/1969 | Cross | F42B 1/02 | 102/306 |
| 5,479,860 A * | 1/1996 | Ellis | E21B 43/1185 | 102/202.7 |
| 5,792,977 A * | 8/1998 | Chawla | F42B 1/032 | 102/307 |
| 6,925,924 B2 * | 8/2005 | Baker | F42B 1/02 | 89/1.151 |
| 9,175,936 B1 * | 11/2015 | Collier | F42B 1/032 | |

* cited by examiner

*Primary Examiner* — David J Bagnell
*Assistant Examiner* — Ronald R Runyan
(74) *Attorney, Agent, or Firm* — Derek R. Van Gilder

(57) ABSTRACT

This patent relates to lined shaped explosive devices, in particular it relates to linear Shaped Charges (SC), more particularly it relates to a Fluted or Scalloped Linear Shaped Charge. The fluted linear SC, unlike a standard linear SC produces hydrodynamic penetration, higher jet velocities, higher mass jets and deeper penetration. The fluted linear device disclosed herein produces greater compression and convergence of the liner material because of the partial radial collapse of the concave flutes. Further, the fluted linear SC is equipped with a simultaneous initiation of the full length of the explosive driving the liner, providing smooth detonation wave front along the full length of the fluted linear liner.

14 Claims, 8 Drawing Sheets

FLUTED LINEAR SHAPED CHARGE WITH SIMULTANEOUS INITIATION

CROSS-REFERENCE TO RELATED APPLICATIONS

This application claims the benefit of and priority to U.S. Provisional Patent Application Ser. No. 62/466,296 filed on Mar. 2, 2017, which application is incorporated herein by reference in its entirety.

BACKGROUND OF THE INVENTION

Shaped Charges, Devices, General:

A shaped charge in the broadest context is any piece of high explosive ("HE") material shaped to perform a specific task lined or unlined. There are basically two types of shaped charges, Axisymmetric and Linear or planer symmetric. By far the most common type of shaped charge is the axisymmetric conical lined shaped charge. These charges, commonly used in anti-armor and oil well perforating, are essentially a hollow cylinder containing a hollow cone type metal liner having explosive material filling the remaining space in the cylinder aft of the cone. Liners are usually made from copper, although it could be made of many other materials, having an explosive billet to which the outside of the liner is exactly mated.

When the explosive material contained in a shaped charge is detonated at the center of the aft end of the explosive, above the apex or pole of the liner, a detonation wave spreads spherically into the explosive material, in the process collapsing the liner into a rod like stretching projectile commonly called a jet. There is another less known form of shaped charge called a linear shaped charge that collapses its liner into a sheet like jet, it is useful in many applications and can be safely fabricated and used.

A Linear shaped charge, sometimes referred to as a line charge, is essentially a V shaped straight hollow thin walled trough liner backed on the outside of the V by an appropriately shaped explosive mass. When intentionally detonated above the apex of the liner, this linear shaped charge produces sheet or ribbon like jetting.

Present day conventional Linear shaped charges (LSC) consist of a thin, flat-walled, long hollow trough-like liner, backed on the outside by a correctly shaped amount of explosive, contained in a body and having an initiation system. When the explosive is intentionally detonated above the apex of the liner the explosive pressure drives the two sides of the trough together producing a sheet or ribbon like jet that cuts a slot approximately the length of the linear shaped charge. These special purpose devices are generally short in length and are initiated at a single point or maybe multiple points along the crown of the HE billet. This type of initiation does not produce a well-defined or controllable jet, the leading edge is ragged and penetration depth inconsistent along its length. The standard smooth wall linear shaped charge gives only a two-dimensional collapse (a result of no liner wall axial curvature) of the liner material and typically produces an explosively formed projectile rather than a jet and slug.

Conventional LSC consist of a rectangular block of explosive with an angular valley in one of its long sides lined with a thin metal liner. Typically, conventional LSC produce sheet projectile velocities from about 1.5 to 2.2 km/s, with little to no jet material velocity gradient and consequently shorter jet and less penetration. The sheet jets have a ragged leading edge because of the non-simultaneous linear initiation system. Conventional LSC do not penetrate hydro dynamically, the same way axisymmetric (i.e. conical) shaped charges do, it is the shaped mass and velocity of the sheet jet that shears the material with brute force leaving large burrs or flaring of the casing in an oil well application.

The jetting occurring in a conventional LSC is not Munroe jetting as the collapse is only two dimensional (does not have axisymmetric convergence) and does not reach the required temperature for plastic flow to take place. As a further recognition of the inefficiency of a conventional LSC the detonation wave does not reach the full length of the liner apex simultaneously, this causes an undesirable dispersion of the resulting spray of liner material and no real continuity to the spray.

Conventional planer symmetric "V" shaped linear liners used in LSC have no curvature or radial convergence and produce low velocity jets. Conventional LSC have large explosive to liner mass ratios and form low velocity (about 2.0 km/s) thin blade or ribbon jet that produce shallow target cuts (mostly non-plastic erosion much like water jet cutting). Conventional LSC are non-precision, low efficiency, cutting charges, without axisymmetric radial convergence the explosive mass must be increased greatly to create the very high pressures needed to produce a very thin ribbon jet from the linear liner; because of the high HE mass most of the penetration from a conventional LSC is made from the hollow cavity effect of the explosive with very little penetration from the liner. Because of their large HE to liner mass ratio conventional LSC can't make precision deep target cuts or penetrations and typically produce a wide cratering effect from the collateral damage of the large amount of explosive.

Conventional LSC have not been researched, developed, refined or used to the extent that axisymmetric shaped charges have. There are many undesirable aspects of existing conventional LSC such as a two-dimensional collapse, the lack of a simultaneous initiation system, and poor penetration performance. The poor and inconsistent performance is primarily because of the lack of a simultaneous initiation along the full length of the explosive billet and the two-dimensional collapse from a smooth walled liner.

Accordingly, there is a need in the art for a better performing LSC. Therefore, this inventor has conducted experiments and invented a novel improvement to LSC and their jetting performance.

BRIEF SUMMARY OF SOME EXAMPLE EMBODIMENTS

This Summary is provided to introduce a selection of concepts in a simplified form that are further described below in the Detailed Description. This Brief Summary is not intended to identify key features or essential characteristics of the claimed subject matter, nor is it intended to be used as an aid in determining the scope of the claimed subject matter.

One example embodiment includes a fluted linear shaped charge device. The fluted linear shaped charge device includes a containment body. The containment body includes a closed end and one or more initiation ports, where the one or more initiation ports each include an aperture through the closed end. The containment body also includes one or more curved surfaces adjacent the closed end and an open end opposite the closed end. The closed end and the one or more curved surfaces create an enclosure. The fluted linear shaped charge device also includes one or more initiators, where each initiator passes through one of the one or more initiation ports from the exterior of the enclosure to the interior of the enclosure and a simultaneous initiation plate on the exterior of the enclosure, the simultaneous initiation plate configured to ensure that each initiator detonates simultaneously. The fluted linear shaped charge device further includes a fluted liner, where the fluted liner includes one or more flutes. A portion of the one or more flutes match the curvature of the one or more curved surfaces in the containment body at the open end and are in contact with the containment body at the open end. The fluted linear shaped charge device additionally includes a high explosive billet. The high explosive billet is in contact with a portion of the initiator and is placed between the closed end of the containment body and the fluted liner.

Another example embodiment includes a system for removal of at least a portion of an oil well casing, the removed casing being disposed of within the oil well. The system includes a casing cutter, the casing cutter configured to cut an oil well casing to a desired length. The system also includes a fluted linear shaped charge device. The fluted linear shaped charge device includes a containment body. The containment body includes a closed end and one or more initiation ports, where the one or more initiation ports each include an aperture through the closed end. The containment body also includes one or more curved surfaces adjacent the closed end and an open end opposite the closed end. The closed end and the one or more curved surfaces create an enclosure. The fluted linear shaped charge device also includes one or more dual line initiation cups. Each dual line initiation cup passes through one of the one or more initiation ports from the exterior of the enclosure to the interior of the enclosure and includes a first branch and a second branch. The fluted linear shaped charge device moreover includes a simultaneous initiation plate on the exterior of the enclosure, the simultaneous initiation plate configured to ensure that each dual line initiation cup detonates simultaneously. The fluted linear shaped charge device additionally includes a shock attenuator, where the shock attenuator includes a low sound speed material placed between the first branch and the second branch of each dual line initiation cup. The fluted linear shaped charge device further includes a fluted liner, where the fluted liner includes one or more flutes. A portion of the one or more flutes match the curvature of the one or more curved surfaces in the containment body at the open end and are in contact with the containment body at the open end. The fluted linear shaped charge device additionally includes a high explosive billet. The high explosive billet is in contact with a portion of the first branch and the second branch of each dual line initiation cup and is placed between the shock attenuator and the fluted liner.

Another example embodiment includes a method for removal of at least a portion of an oil well casing, the removed casing being disposed of within the oil well. The method includes cutting an oil well casing at a first location to a desired length and arc length using a casing cutter. The method moreover includes cutting the oil well casing at second first location to a desired length and arc length using the casing cutter. The method also includes placing a fluted linear shaped charge device between the first location and the second location. The fluted linear shaped charge device includes a containment body. The containment body includes a closed end and one or more initiation ports, where the one or more initiation ports each include an aperture through the closed end. The containment body also includes one or more curved surfaces adjacent the closed end and an open end opposite the closed end. The closed end and the one or more curved surfaces create an enclosure. The fluted linear shaped charge device also includes one or more dual line initiation cups. Each dual line initiation cup passes through one of the one or more initiation ports from the exterior of the enclosure to the interior of the enclosure and includes a first branch and a second branch. The fluted linear shaped charge device moreover includes a simultaneous initiation plate on the exterior of the enclosure, the simultaneous initiation plate configured to ensure that each dual line initiation cup detonates simultaneously. The fluted linear shaped charge device additionally includes a shock attenuator, where the shock attenuator includes a low sound speed material placed between the first branch and the second branch of each dual line initiation cup. The fluted linear shaped charge device further includes a fluted liner, where the fluted liner includes one or more flutes. A portion of the one or more flutes includes a frusto conical shape match the curvature of the one or more curved surfaces in the containment body at the open end and are in contact with the containment body at the open end. Each flute includes a liner. The fluted linear shaped charge device additionally includes a high explosive billet. The high explosive billet is in contact with a portion of the first branch and the second branch of each dual line initiation cup and is placed between the shock attenuator and the fluted liner. The method further includes initiating the detonation of the fluted linear shaped charge device.

These and other objects and features of the present invention will become more fully apparent from the following description and appended claims, or may be learned by the practice of the invention as set forth hereinafter.

BRIEF DESCRIPTION OF THE DRAWINGS

To further clarify various aspects of some example embodiments of the present invention, a more particular description of the invention will be rendered by reference to specific embodiments thereof which are illustrated in the appended drawings. It is appreciated that these drawings depict only illustrated embodiments of the invention, and are therefore not to be considered limiting of its scope. The invention will be described and explained with additional specificity and detail through the use of the accompanying drawings in which.

DETAILED DESCRIPTION OF SOME EXAMPLE EMBODIMENTS

Figure 1:
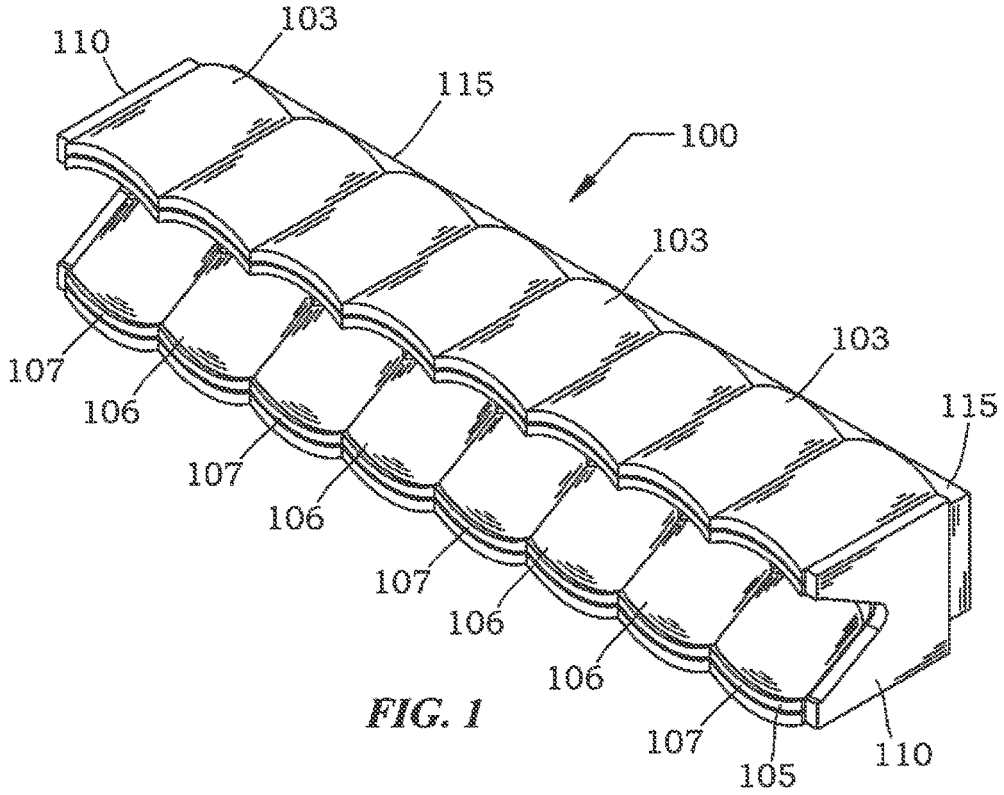
FIG. 1 is a perspective view that illustrates an example of a fluted linear shaped charge.

For clarity, all references in this document to a shaped charge means, "a shaped charge" is an explosive device, having a shaped liner, driven by a similarly shaped mating explosive billet, having an initiation device, the necessary containment, confinement and retention of the liner to the explosive billet. The result of intentional detonation of this device is a high-speed stream of material produced from the convergence of the liner driven by the explosive. This is commonly known as the Munroe Effect. The shape, size and velocity of this stream of material commonly called a jet, is dependent on the starting geometry and thickness of the liner and explosive billet.

This invention relates to shaped explosive devices, and, in particular, to a shaped explosive device that produces a linear hydrodynamic penetrating shaped stretching jet. This explosive device is hereinafter referred to as "The Fluted Linear" device or Fluted Linear shaped charge, which consists of a liner, an explosive billet, a body and a means of simultaneous initiation.

The Fluted Linear device will produce a high velocity, high mass, variable length sheet jet, that produces an elongated slot either straight or splined in a target material. The invention described and depicted herein produces sheet jetting similar to a traditional linear shaped charge, but at much higher velocities, having a jet velocity gradient or stretch rate, directionally controllable, and only using a quarter of the amount of explosive of a traditional linear charge.

A Fluted Linear shaped charge device is capable of producing deep slotted penetrations of almost any length and shape. Its scope of use is vast and can be used where any cutting operation is needed in metals, rock, reinforced concrete, other materials. In these fields of use: Oil & Gas operations, mining, demolition, military, space exploration.

In the preferred configuration of the fluted linear shaped charge, the collapsing liner walls have multiple like flutes with partial radial collapse due to the contours of the concave flutes or scallops. This configuration, along with a novel single or dual line initiation system, will produce precision high speed sheet jets capable of long cuts and deep hydrodynamic slotted penetration.

The fluted or scalloped LSC disclosed herein is specifically designed to hydro dynamically cut through steel and concrete barriers such as oil well casings, but also has many other uses where long deep cuts are needed (i.e. demolition, well casing removal, mining, military uses, etc.). This innovation in linear shaped charges produces high compression on the liner material which in turn gives higher jet velocities and controlled high mass sheet jets not possible with existing conventional linear shaped charges. Fluted linear liners require less explosive to make equal to and or deeper target cuts than traditional linear liners. This new innovation in linear shaped charges solves the problems mentioned above by:

1) having an initiation strip that gives simultaneous dual or single line initiation along the full length of the aft end of the explosive billet.

2) having a scalloped or fluted linear liner that gives greater liner material convergence which produces much higher pressures and Monroe jetting unlike conventional linear shaped charges.

One skilled in the art will understand the difference between the two types of penetration or depth of cutting power. In the case of two flat walls of a conventional linear liner collapsing, it only shapes the liner material into a sheet like configuration. It lacks the compression and pressure to liquefy the liner material, cannot provide hydrodynamic penetration and gives only low jet velocities.

A fluted linear shaped charge with a multi-curved or fluted liner is capable of producing the necessary material convergence for a high velocity stretching sheet jet above 4.0 km/s, which is capable of producing deep hydrodynamic plastic target material penetrations from a much lower HE to liner mass ratio than a conventional linear shaped charge.

Shaped charge liners come in many shapes, angles and sizes, the disclosure in this patent application intends this wide variety of options (as shown in figure section) as part and parcel of the claims of this application.

FIG. 1 is a perspective view of a fluted linear shaped charge device 100, with a fluted liner 105 that consists of eight curved frustro conical liner flutes 106 that are backed by a high explosive ("HE") billet, with liner flutes base end 107 at the forward end of the device, containment body 103, a simultaneous initiation plate 115 at the aft end of the device, and explosive containment end plates 110. In this configuration, the fluted linear shaped charge device 100 has a dual line initiation system that controls the angle of the detonation wave relative to the liner wall which improves the collapse or driving of the liner flutes 106. The included angle of liner flutes 106 can vary from 36 degrees to 120 degrees and still produce The Munroe Effect jetting, that is to say a ductile jet having a velocity gradient from tip to tail. A wide-angle liner reduces the charge length to diameter ratio (L/D), and dual line initiation allows the reduction of charge length without reducing jet mass or velocity, unlike a point initiation system. A conventional point initiation of the same explosive and liner dimensions would result in a lower mass and lower velocity jet.

Figure 1A:
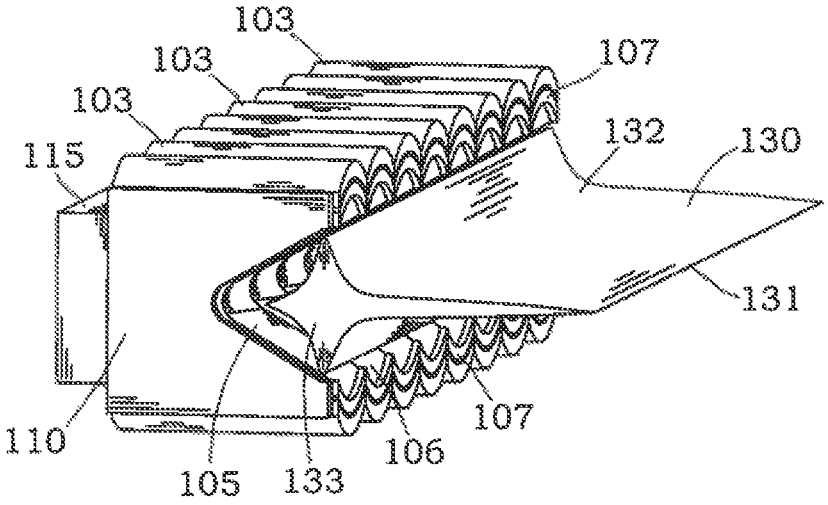
FIG. 1A is a perspective view of a sheet jet formed by the device embodiment of FIG. 1.

FIG. 1A is a perspective view of the embodied device with an example of the linear sheet jet that the device produces after detonation. Linear sheet jet 130 consists of a forward thin jet tip 131, a thicker jet tail 132 and an aft slug 133. Jet 130 is formed along the devices central plane of symmetry from the collapse of liner 105, which is a result of a detonation shock wave and extreme material converging pressures (created from the detonation of the HE billet) that progress from the aft to the forward end of device 100.

The velocity of jet 130 is greatest at jet tip 131 and has a lower velocity at the jet tail 132 near the forward end of slug 133. Jet velocities or velocity gradient from tip 131 to tail 132 are a function of the device design, explosive type, and fluted liner 105 material properties. The jet velocity gradient and material ductility directly affect the stretch rate of jet 130 which also affects its length and thickness. Higher velocity gradients will result in a thinner and longer jet due to forward stretching of higher velocity material at the forward end of the sheet jet.

This depiction of jet 130 is at a finite time after the detonation of device 100. Jet 130 at an earlier time frame would be shorter in length and thicker, and at a later time it would have stretched forward becoming longer and thinner.

The slug 133 is a transitional area where collapsing liner material is contributed to jet 130. As time progresses and at some sheet jet 130 elongation, the higher velocity sheet jet will break free from the lower velocity slug 133. Slug 133 could be a solid and act much like an explosively formed projectile (EFP) when impacting a target or could be frangible depending on liner material properties and application requirements.

Figure 2:
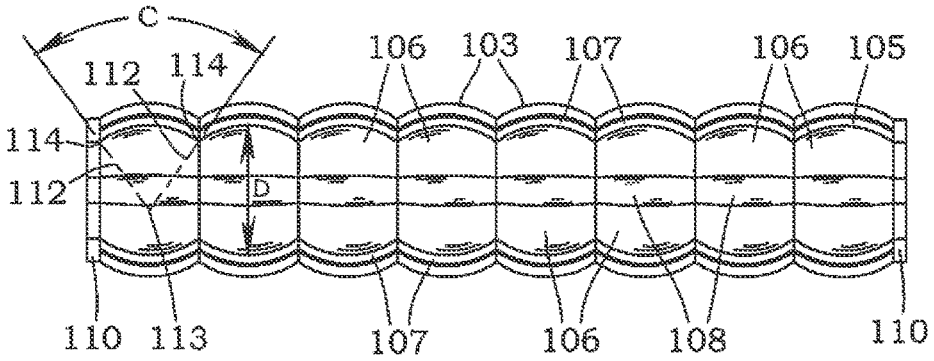
FIG. 2 is a front view of the device in FIG. 1, illustrating the curvature of the fluted liner and body.

FIG. 2 is an elevated front view of the linear shaped charge device 100 in FIG. 1 that illustrates the curvature of the fluted liner base end 107 in relation to containment body 103. Base end 107 of liner 105 and its flutes 106 match the forward end curvature of containment body 103 and is in intimate contact with containment body 103. The base end 107 geometry of each flute 106 is a chord of a circle bound by two equal length radii 112. The radii 112 lines are of equal length and extend from the chord central axis 113 to cord end points 114 of each flute. The chord length of each flute base end 107 can be increased or decreased to change liner geometry and jet characteristics. The chord length will decrease if the radii 112 length decreases or if the angle C between the radii 112 decreases and will increase if the radii length increases or if the angle C between the radii 112 increases. Angle C of the flutes can vary from 30 to 180 degrees, but each flute on liner 105 must have the same angle C and chord length to have the symmetry needed for radial convergence of the flutes. The base end 107 illustrated in these figures is a chord of a circle but could also be a chord of other geometrical shapes (i.e. ellipse, parabola, or hyperbola).

Liner 105 has multiple like flutes 106 that are hollow curved concavities that are planer symmetric about a longitudinal mid-plane that bisects and passes through the center of apex 108 of each flute. The longitudinal mid-plane of symmetry that passes though the center of the flutes apex 108 is the same plane that the sheet jet forms on during liner 105 collapse. During liner collapse from the HE billet detonation, these curved concavities or flutes provide the material convergence and work required to produce extreme pressures in the collapsed liner material, which increases the temperature and ductility resulting in plastic flow or jetting of the liner material. The collapse of fluted liner 105 produces a planer forward stretching sheet jet along the longitudinal mid-plane that bisects apex 108 and is capable of hydrodynamic penetration and cutting long deep slots.

To achieve a precise and controllable sheet jet from a linear shaped charge it is essential to have simultaneous initiation along the full length of the explosive billet. For optimum performance the initiation system should be located in correct relationship to the apex 108 being on and parallel to the mid-plane of symmetry that bisects apex 108 and the included angle of the liner flutes 106. Containment body 103 could be made of one or multiple parts fastened together and made from a material that gives the correct tamping needed for ultimate charge performance. The aft end of body 108 could be tapered or boat-tailed to reduce the mass of the main explosive charge.

Figure 3:
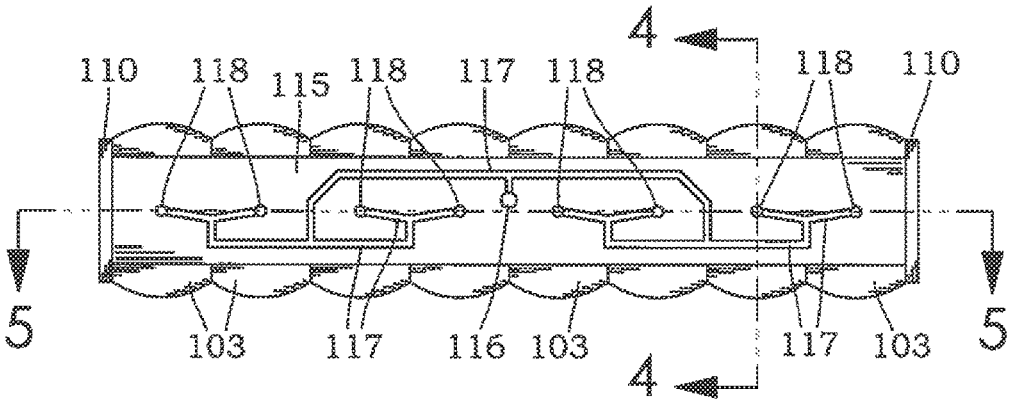
FIG. 3 is an aft view of the device in FIG. 1, illustrating the simultaneous initiation plate with high explosive filled channels to each flute.

FIG. 3 is an elevated aft view of linear shaped charge device 100 illustrating the initiation plate 115 and the explosive filled channels 117. Initiation plate 115 is in intimate contact with in the full longitudinal length of containment body 103 and can be made of a very low sound speed material (where low sound speed material is defined as a material having a sound speed below 1000 m/s and a very low sound speed material is defined as a material having a sound speed below 50 m/s). The initiation plate has symmetrical, equal length explosive filled channels 117 that allow simultaneous initiation along the full length of the explosive billet from a single primary initiation point 116. Equal length channels 117 are filled with explosive of sufficient diameter to sustain a detonation wave from a single initiation point 116 to the individual flute initiation ports 118. The initiation ports 118 are through holes with outputs on the opposite or forward side of the plate that are filled with explosive. The output of the explosive in the initiation ports are in intimate contact with the dual line initiation explosive. An initiation plate with equal length explosive trace lines leading from a single point to multi-points enables same time or simultaneous initiation of the main explosive billet driving each flute.

Figure 4:
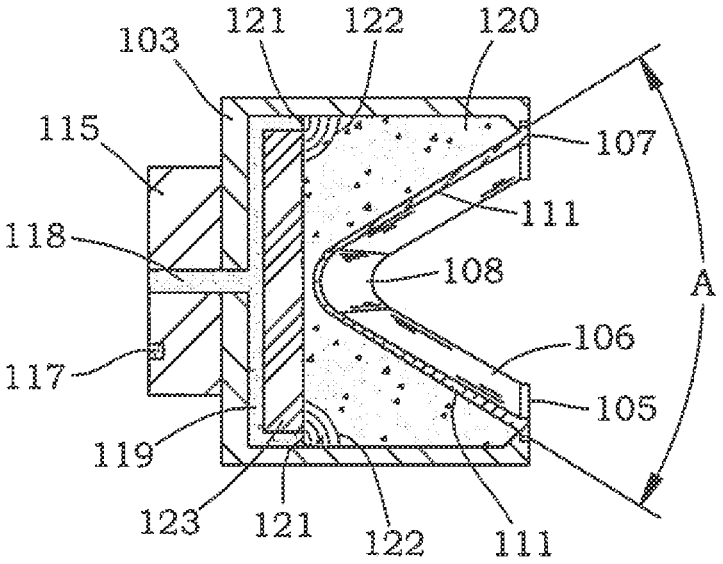
FIG. 4 is a sectional view about vertical line 4-4 in FIG. 3 further clarifying the construction of the device in FIG. 1.

FIG. 4 is a cross sectional view about line 4-4 in FIG. 3 of linear shaped charge device 100 that further illustrates the construction of a single flute 106 from liner 105 and its orientation with the dual initiation cup 119 and initiation plate 115. Dual initiation cup 119 can be made from any suitable high explosive and should be of sufficient cross-sectional width or diameter to maintain detonation. This cross-sectional view shows a liner flute 106 that has an initiation port 118 at the aft end of containment body 103 that contains a high explosive with a forward output point at the aft end of the dual line initiation cup 119. Initiation port 118 is aligned with the axial center of dual line initiation cup 119. Initiation port 118 transfers the detonation through initiation plate 115 and containment body 103 to dual line initiation cup 119 which then initiates the aft end of main explosive HE billet 120 at the periphery explosive interfaces 121 generating a dual line simultaneous initiation of the main explosive billet 120 along its full length (illustrated by detonation wave lines 122).

The jet velocity achieved from a shaped charge is dependent on many factors. The liner wall 111 thickness and included angle A of liner 105 are two of the most important variables; a narrower included angle A results in a faster less massive jet, and a wider included angle A results in a slower more massive jet. The thickness of the liner wall 111 can gradually increase or decrease from the apex 108 to the base end 107 or anywhere along the wall length to modify jet characteristics; a tapering liner wall 111 thickness will help balance the liner to HE mass ratio as the liner flute radius 112 increases toward the base end 107. Jet velocities can vary from 4 to 10 km/s depending on these variables: type and quality of liner material; included angle A of the liner; liner wall thickness; the charge to mass ratio of HE to liner; density of the liner; surface finish of the liner wall; and, containment body geometries. Very small changes of any of these variables can make significant differences in jet velocity and trajectory. The included angle A of liner 105 needed to obtain Munroe Effect jetting should be from 36 to 150 degrees. The thickness of liner wall 111 needed to obtain Munroe Effect jetting should be from 0.030 inches to 0.065 inches.

Liner thickness of shaped charges are dependent on the overall diameter of the device, the liner wall 111 should increase in thickness as the liner flute radius 112 increases and decrease in thickness as the liner radius 112 decreases. Shaped charges scale very nicely and for a person skilled in this art making this device in any size would be evident based on the information given. Shaped charges by their very nature have varying liner wall thicknesses and profiles depending on liner material type, liner density, the jet velocity required, and desired effect on a target.

Between the dual line initiation cup 119 and main HE billet 120 is an initiation shock attenuator 123 made from a low sound speed material that controls the direction of initiation detonation shock waves. Shock attenuator 123 directs the detonation from port 118 into lateral and radial trajectories that produces dual line detonation at the aft end of main HE billet 120. Shock attenuator 123 also dampens or retards sympathetic detonation of the main explosive from the detonation of the dual line initiation cup 119 which provides sufficient time for proper dual line initiation of main HE billet 120, liner collapse and jet formation.

Peripheral initiation of main HE billet 120 generates dual detonation waves illustrated by curved lines 122 in FIG. 4. The dual waves symmetrically collapse the liner walls 111 of all liner flutes simultaneously. Having the capability to initiate the main HE billet 120 at its periphery makes it possible to direct a dual plane detonation wave from each side of the aft end of the HE billet 120. Directing a detonation in this manner increases the force of collapse of the liner accomplishing more compression of the liner material which contributes greatly to ductility, jet length, velocity and thusly penetration depth.

Figure 5:
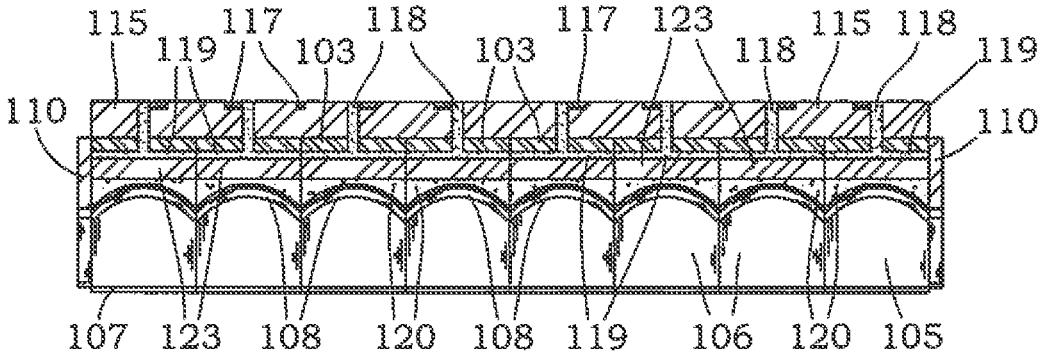
FIG. 5 is a sectional view about horizontal line 5-5 in FIG. 3 further clarifying the construction of the device in FIG. 1.

FIG. 5 is a cross sectional view about line 5-5 in FIG. 3 that further illustrates the construction of linear shaped charge device 100. This cross-sectional view is at the mid plane of linear shaped charge device 100 and illustrates liner 105 that consists of eight flutes 106 and dual line initiation cups 119 aft of each flute. Initiation plate 115 has eight initiation ports 118 that are aligned with the central axis of dual line cups 119 and also with the symmetrical center plane of each flute 106 and each apex 108. FIG. 5 shows the symmetry of all flutes 106 with initiation ports 118 at a central location of each flute, this symmetry facilitates the simultaneous collapse of the full length of liner 105.

Figure 6:
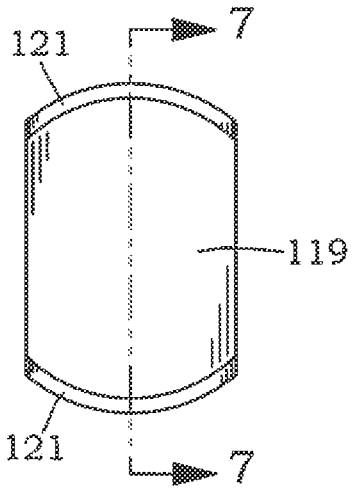
FIG. 6 is a front view that further clarifies the construction of the dual line precision initiation cup high explosive shown in the FIG. 4 section view.

FIG. 6 is a front view elevation of a single initiation cup 119 with forward dual outputs 121 that would initiate the main HE billet of a single flute. Outputs 121 are symmetrical curved partial arcs as shown in FIG. 6, these outputs could be straight or other geometries if needed to modify charge performance.

Figure 7:
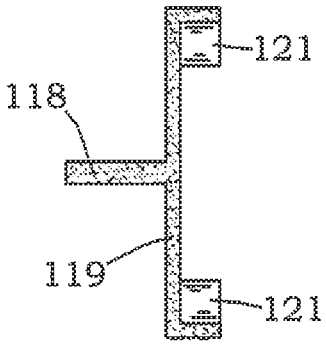
FIG. 7 is a sectional view about vertical line 7-7 in FIG. 6 further clarifying the construction of the dual line precision initiation cup high explosive in FIG. 6.

FIG. 7 is a cross sectional view about line 7-7 in FIG. 6 of initiation cup 119 that further illustrates its construction showing the initiation port HE 118 connected to the aft end of dual line initiation cup 119 and the dual line outputs 121 at the forward end. HE billet can be pressed, cast or hand packed from any commercially available high order explosive. The head height of HE billet (space between liner apex and shock attenuator) can be lengthened or shortened longitudinally by increasing or decreasing the length of containment body, greater head height gives a flatter detonation wave before it comes in contact with the liner. Flatter detonation waves at time of liner impact typically increase jet tip velocity and target penetration. Head height optimization is a balance between jet performance and minimizing the explosive charge. HE billet can have a super-caliber diameter (i.e. larger than the liner base diameter) at the forward end if necessary for full convergence of the base end of the liner to obtain maximum velocity and mass of the jet.

Shape charge liners for the most part are made from copper, but liners may be made from almost any metal, ceramic, powdered metals, tungsten, silver, copper, glass or combination of many materials. Containment body serves as a containment vessel for the HE billet and liner. Containment body protects HE billet and provides the needed tamping for the explosive, and would typically be made from aluminum or steel but could be made of almost any metal or plastic.

Dual line initiation facilitates a more acute angle of attack of the detonation wave to the liner wall than would be produced by a point or single line initiation system. This detonation wave shaping will produce high mass high velocity sheet jets for both narrow and wide included angle liners up to 150 degrees. Dual line simultaneous initiation of a linear fluted shaped charge produces a high velocity stretching sheet jet that produces deeper cutting performance.

Figure 8:
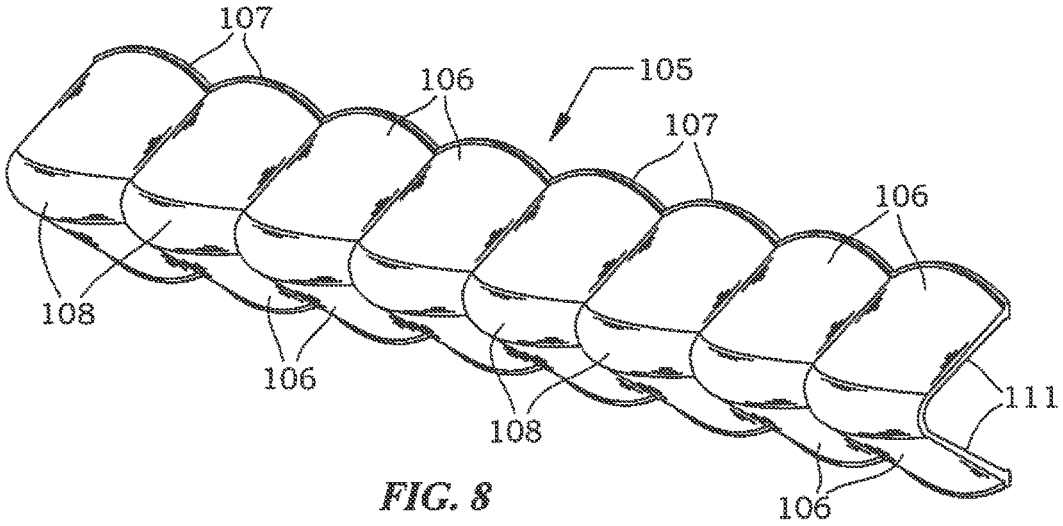
FIG. 8 is a perspective aft view of the fluted linear liner from the device in FIG. 1 further clarifying its construction.

FIG. 8 is an aft perspective view of one possible variation of a fluted linear liner 105 that can be implemented in the FIG. 1 embodied linear shaped charge device. This liner variation has eight flutes 106, but could have as many or as few flutes as needed. Each flute 106 consists of two opposed planar symmetric forward inclined frustal conical portions that are joined together at the plane of symmetry by an aft parabolic apex 108. The liner wall 111 can vary in thickness from aft apex 108 to forward base end 107 of flutes 106. Apex 108 radius can be increased or decreased and could also be other geometrical shapes (i.e. flattened, or sharp edge with no radius) to modify jet properties and its desired effect on targets.

Figure 9:
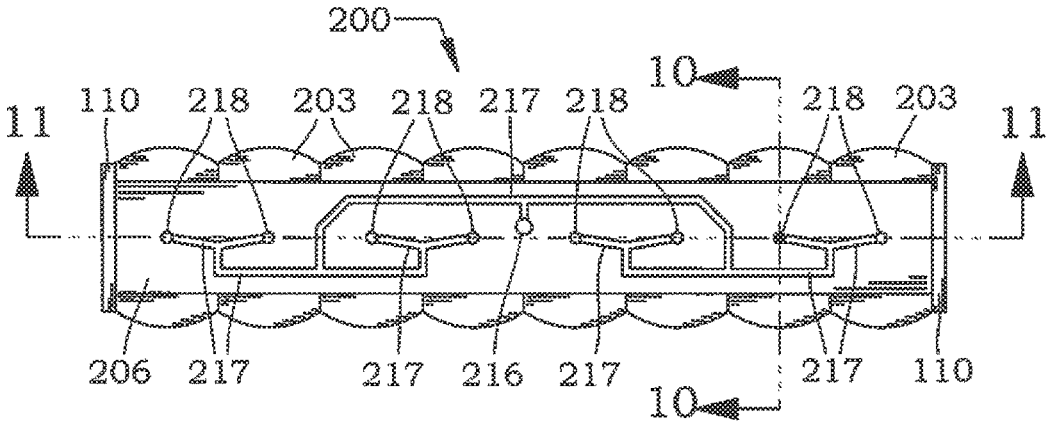
FIG. 9 is an aft view of an alternative configuration of the device in FIG. 1 that has single line precision initiation of the high explosive billet.

Device 200 illustrated in FIG. 9, is an aft view of an alternate configuration of the FIG. 1 embodiment with a single line simultaneous initiation of the main HE billet. When device 200 is initiated from a single initiation point 216 the detonation propagates the full length of the device and arrives at each liner flute simultaneously via equal length explosive filled channels 217 and initiation ports 218 in initiation plate 206.

Figure 10:
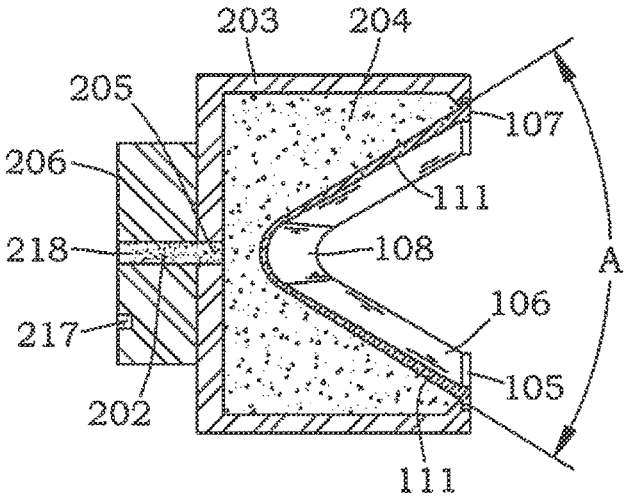
FIG. 10 is a sectional view about vertical line 10-10 in FIG. 9 further clarifying the construction of the device in FIG. 9.
Figure 11:
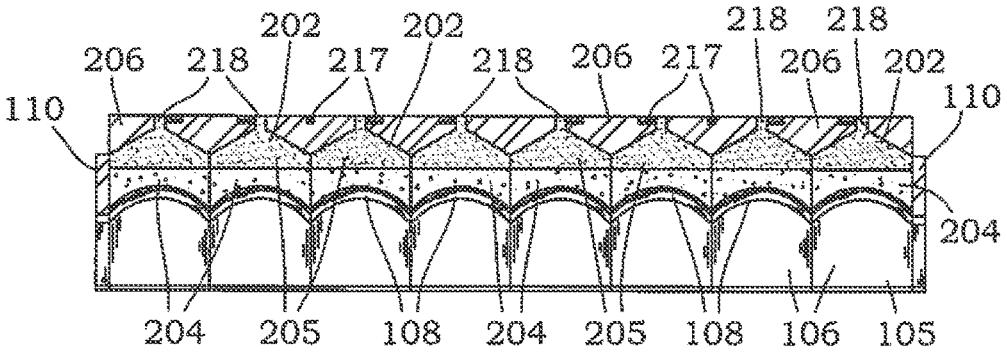
FIG. 11 is a sectional view about horizontal line 11-11 in FIG. 9 further clarifying the construction of the device in FIG. 9.

FIG. 10 is a vertical cross section along line 10-10 in FIG. 9, and FIG. 11 is a horizontal cross section along line 11-11 in FIG. 9, which further illustrates the construction of device 200. Device 200 incorporates fluted liner 105 of FIG. 8 with a single line initiation plate 206 that simultaneously initiates the HE billet 204 the full longitudinal length of device 200, directly above each flute apex 108, and on the longitudinal bisecting mid plane of the device that's coincident with line 11-11.

The detonation of device 200 starts at a single initiation point on the aft side of plate 206, then propagates along explosive filled channels 217, and simultaneously arrives at each of the initiation ports 218 for all flutes. The detonation wave then travels through the initiation plate via ports 218 and propagates forward and in lateral directions through inclined troughs of the initiation explosive 202 on the forward side of initiation plate 206. The increasing width of the inclined troughs of initiation explosive 202 at the forward end of the trough creates a simultaneous initiation path the full longitudinal length of device 200 and main HE billet 204. The detonation of explosive 202 propagates through an aft linear slot 205 in body 203 and then propagates into the aft end of HE billet 204 the full length of device 200. By the time the detonation wave reaches the HE billet 204, it is a planer wave initiating the full length of HE billet 204. Initiating the full length of HE billet 204 simultaneously is required to obtain a stable continuous hydrodynamic sheet jet from the collapse of fluted linear liner 105.

What is claimed is:

1. A fluted linear shaped charge device, the fluted linear shaped charge device comprising:

a containment body, wherein the containment body includes:

a closed end;

one or more initiation ports, wherein the one or more initiation ports each include an aperture through the closed end of the containment body;

one or more curved surfaces adjacent the closed end; and an open end opposite the closed end;

the closed end and the one or more curved surfaces create an enclosure;

one or more initiators, wherein each initiator passes through one of the one or more initiation ports from the exterior of the enclosure to the interior of the enclosure;

a simultaneous initiation plate on the exterior of the enclosure, the simultaneous initiation plate:

configured to ensure that each initiator detonates simultaneously; and including a very low sound speed material a fluted liner, wherein the fluted liner includes:

one or more flutes, wherein:

a portion of the one or more flutes:

match the curvature of the one or more curved surfaces in the containment body at the open end; and are in contact with the containment body at the open end; and a high explosive billet, wherein the high explosive billet:

is in contact with a portion of the initiator; and is placed between the closed end of the containment body and the fluted liner.

2. The fluted linear shaped charge device of claim 1 wherein at least one component is frangible.

3. The fluted linear shaped charge device of claim 1 wherein at least one component is powdered metal.

4. The fluted linear shaped charge device of claim 1 further comprising:

a first end plate on a first side of the container body; and a second end plate on a second side of the container body, wherein the second end plate is opposite the first side.

5. The fluted linear shaped charge device of claim 1 wherein each flute in the fluted liner includes frusto conical liner flutes.

6. The fluted linear shaped charge device of claim 1 wherein each flute in the fluted liner includes a parabolic apex.

7. The fluted linear shaped charge device of claim 1 wherein the fluted liner includes a liner wall.

8. The fluted linear shaped charge device of claim 7 wherein the liner wall is tapered.

9. A system for removal of at least a portion of an oil well casing, the removed casing being disposed of within the oil well, the system comprising:

a casing cutter, the casing cutter configured to cut an oil well casing to a desired length; and a fluted linear shaped charge device, wherein the fluted linear shaped charge device includes:

a containment body, wherein the containment body includes:

a closed end;

one or more initiation ports, wherein the one or more initiation ports each include an aperture through the closed end of the containment body;

one or more curved surfaces adjacent the closed end; and an open end opposite the closed end;

the closed end and the one or more curved surfaces create an enclosure;

one or more dual line initiation cups, wherein each dual line initiation cup:

passes through one of the one or more initiation ports from the exterior of the enclosure to the interior of the enclosure; and includes:

a first branch; and a second branch;

a simultaneous initiation plate on the exterior of the enclosure, the simultaneous initiation plate:

configured to ensure that each dual line initiation cup detonates simultaneously; and including a very low sound speed material;

a shock attenuator, wherein the shock attenuator includes a low sound speed material placed between the first branch and the second branch of each dual line initiation cup;

a fluted liner, wherein the fluted liner includes:

one or more flutes, wherein:

a portion of the one or more flutes:

match the curvature of the one or more curved surfaces in the containment body at the open end; and are in contact with the containment body at the open end; and a high explosive billet, wherein the high explosive billet:

is in contact with a portion of the first branch and the second branch of each dual line initiation cup; and is placed between the shock attenuator and the fluted liner.

10. The system of claim 9 wherein the initiation plate includes explosive filled channels.

11. The system of claim 10, wherein the explosive filled channels are equal length.

12. A method for removing of at least a portion of an oil well casing, the removed casing being disposed of within the oil well, the method comprising:

cutting an oil well casing at a first location to a desired length and arc length using a casing cutter;

cutting the oil well casing at second location to a desired length and arc length using the casing cutter;

placing a fluted linear shaped charge device between the first location and the second location, wherein the fluted linear shaped charge device includes:

a containment body, wherein the containment body includes:

a closed end;

one or more initiation ports, wherein the one or more initiation ports each include an aperture through the closed end of the containment body;

one or more curved surfaces adjacent the closed end; and an open end opposite the closed end;

the closed end and the one or more curved surfaces create an enclosure;

one or more dual line initiation cups, wherein each dual line initiation cup:

passes through one of the one or more initiation ports from the exterior of the enclosure to the interior of the enclosure; and includes:

a first branch; and a second branch;

a simultaneous initiation plate on the exterior of the enclosure, the simultaneous initiation plate:

configured to ensure that each dual line initiation cup detonates simultaneously; and including a very low sound speed material;

a shock attenuator, wherein the shock attenuator includes a low sound speed material placed between the first branch and the second branch of each dual line initiation cup;

a fluted liner, wherein the fluted liner includes:

one or more flutes, wherein:

a portion of the one or more flutes:

includes a frusto conical shape;

match the curvature of the one or more curved surfaces in the containment body at the open end; and are in contact with the containment body at the open end;

each flute includes a liner; and a high explosive billet, wherein the high explosive billet:

is in contact with a portion of the first branch and the second branch of each dual line initiation cup; and is placed between the shock attenuator and the fluted liner; and initiating the detonation of the fluted linear shaped charge device.

13. The method of claim 12 wherein an angle of the frusto conical portion of each flute is between 36 degrees and 150 degrees.

14. The method of claim 12 wherein the thickness of the liner wall is between 0.03 inches and 0.065 inches.

* * * * *